US009487010B2

(12) United States Patent
Tennis et al.

(10) Patent No.: US 9,487,010 B2
(45) Date of Patent: Nov. 8, 2016

(54) INKJET PRINTER WITH CONTROLLED OXYGEN LEVELS

(75) Inventors: Matthew Tennis, Howell, MI (US); Josh Samuel, Ann Arbor, MI (US); Paul Edwards, Saline, MI (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 861 days.

(21) Appl. No.: 12/968,730

(22) Filed: Dec. 15, 2010

(65) Prior Publication Data

US 2012/0154473 A1 Jun. 21, 2012

(51) Int. Cl.

| | |
|---|---|
| ***B41J 2/175*** | (2006.01) |
| ***B41J 2/21*** | (2006.01) |
| ***B41J 11/00*** | (2006.01) |

(52) U.S. Cl.

CPC ..... *B41J 2/175* (2013.01); *B41J 2/2117* (2013.01); *B41J 11/002* (2013.01); *B41J 11/0015* (2013.01)

(58) Field of Classification Search

CPC .... B41J 2/175; B41J 11/002; B41J 11/0015; B41J 2/114; B41J 2/2117

See application file for complete search history.

(56) References Cited

U.S. PATENT DOCUMENTS

| | | | | |
|---|---|---|---|---|
| 2,927,502 | A | 3/1960 | Watrous | |
| 4,326,001 | A | 4/1982 | Sachs et al. | |
| 4,857,086 | A * | 8/1989 | Kawai | 96/111 |
| 4,952,973 | A | 8/1990 | Jones et al. | |
| 5,099,256 | A | 3/1992 | Anderson et al. | |
| 5,267,005 | A | 11/1993 | Yamamoto et al. | |
| 5,284,506 | A | 2/1994 | Barbe | |
| 5,294,946 | A | 3/1994 | Gandy et al. | |
| 5,792,296 | A | 8/1998 | Soltysiak | |
| 6,126,095 | A | 10/2000 | Matheson et al. | |
| 6,154,232 | A | 11/2000 | Hickman et al. | |
| 6,335,140 | B1 | 1/2002 | Miyazaki | |
| 6,461,064 | B1 | 10/2002 | Leonard et al. | |
| 6,522,349 | B1 | 2/2003 | Lee | |
| 6,550,905 | B1 | 4/2003 | Deckers | |
| 6,550,906 | B2 | 4/2003 | Ylitalo | |
| 6,554,414 | B2 | 4/2003 | Ylitalo et al. | |
| 6,593,390 | B1 | 7/2003 | Johnson et al. | |
| 6,598,531 | B2 | 7/2003 | Nedblake, Jr. et al. | |
| 6,683,421 | B1 | 1/2004 | Kennedy et al. | |
| 6,736,918 | B1 | 5/2004 | Ichikawa et al. | |
| 6,789,873 | B2 | 9/2004 | Booth et al. | |

(Continued)

FOREIGN PATENT DOCUMENTS

| | | |
|---|---|---|
| CN | 1606604 A | 4/2005 |
| CN | 1817811 A | 8/2006 |

(Continued)

OTHER PUBLICATIONS

Jack Kenny, UV Curing Technology, Mar. 2009, Label & Narrow Web, retrieved on Oct. 14, 2010 from url: http://www.labelandnarrowweb.com/articles/2009/03/uv-curing-technology; 4 pages.

*Primary Examiner* — Geoffrey Mruk

(74) *Attorney, Agent, or Firm* — Perkins Coie LLP

(57) ABSTRACT

An in-line printing apparatus with an inerting station that delivers an atmosphere having an optimal composition to inert a layer of ink such that LED radiation adequately cures the ink. A process for configuring a printing environment for delivering an atmosphere having an optimal composition to inert a layer of ink such that LED radiation adequately cures the ink.

30 Claims, 5 Drawing Sheets

(56) References Cited

U.S. PATENT DOCUMENTS

| | | | |
|---|---|---|---|
| 6,927,014 | B1 | 8/2005 | Figov |
| 7,278,728 | B2 | 10/2007 | Desie et al. |
| 7,419,716 | B2 | 9/2008 | Tian et al. |
| 7,431,897 | B2 | 10/2008 | Hahne et al. |
| 7,520,601 | B2 | 4/2009 | Claes et al. |
| 8,186,801 | B2 | 5/2012 | Saita et al. |
| 2001/0052924 | A1 | 12/2001 | Steinke et al. |
| 2002/0071000 | A1 | 6/2002 | Rezanka et al. |
| 2002/0119395 | A1 | 8/2002 | Kramer et al. |
| 2002/0149659 | A1 | 10/2002 | Wu et al. |
| 2003/0164571 | A1 | 9/2003 | Crump et al. |
| 2003/0227527 | A1 | 12/2003 | Richards et al. |
| 2004/0029030 | A1 | 2/2004 | Murray |
| 2004/0166249 | A1 | 8/2004 | Siegel et al. |
| 2006/0066703 | A1 | 3/2006 | Kadomatsu et al. |
| 2006/0066704 | A1 | 3/2006 | Nishida et al. |
| 2006/0075914 | A1 | 4/2006 | Kawano |
| 2006/0119686 | A1 | 6/2006 | Odell |
| 2006/0158473 | A1 | 7/2006 | Mills et al. |
| 2006/0182937 | A1 | 8/2006 | Tsuchimura |
| 2006/0197787 | A1 | 9/2006 | Kusunoki et al. |
| 2006/0221161 | A1 | 10/2006 | Hori et al. |
| 2007/0013757 | A1 | 1/2007 | Ohnishi |
| 2007/0040885 | A1 | 2/2007 | Kusunoki |
| 2007/0058020 | A1 | 3/2007 | Wetjens et al. |
| 2007/0115335 | A1 | 5/2007 | Vosahlo et al. |
| 2007/0120930 | A1 | 5/2007 | Domoto et al. |
| 2007/0154823 | A1 | 7/2007 | Marson et al. |
| 2007/0171263 | A1 | 7/2007 | Inoue et al. |
| 2007/0184141 | A1 | 8/2007 | Custer et al. |
| 2007/0278422 | A1 | 12/2007 | Einhorn et al. |
| 2007/0296790 | A1 | 12/2007 | Nakazawa et al. |
| 2008/0018682 | A1 | 1/2008 | Spehrley et al. |
| 2008/0024548 | A1 | 1/2008 | Shang et al. |
| 2008/0156506 | A1 | 7/2008 | Wagner et al. |
| 2008/0158278 | A1 | 7/2008 | Inoue |
| 2008/0192075 | A1 | 8/2008 | Campion et al. |
| 2008/0192100 | A1 | 8/2008 | Nakajima et al. |
| 2008/0199230 | A1 | 8/2008 | Kawano |
| 2008/0218574 | A1 | 9/2008 | Furuno et al. |
| 2009/0085996 | A1 | 4/2009 | Kasai |
| 2009/0086000 | A1 | 4/2009 | Yokota et al. |
| 2009/0122126 | A1 | 5/2009 | Ray et al. |
| 2009/0207223 | A1* | 8/2009 | Cofler et al. ..... 347/102 |
| 2009/0207224 | A1 | 8/2009 | Cofler |
| 2009/0244165 | A1 | 10/2009 | Saita |
| 2009/0246382 | A1 | 10/2009 | Hirato et al. |
| 2010/0080924 | A1 | 4/2010 | Leng |
| 2010/0177151 | A1 | 7/2010 | Thompson et al. |
| 2010/0208020 | A1 | 8/2010 | Matsumoto |
| 2010/0259589 | A1 | 10/2010 | Barry et al. |
| 2010/0309269 | A1 | 12/2010 | Vosahlo et al. |
| 2011/0122596 | A1 | 5/2011 | Miyazaki et al. |
| 2013/0100216 | A1 | 4/2013 | Ohnishi |

FOREIGN PATENT DOCUMENTS

| | | | |
|---|---|---|---|
| CN | 101291999 | A | 10/2008 |
| EP | 0585160 | A1 | 3/1994 |
| EP | 1484370 | A1 | 12/2004 |
| EP | 1913979 | | 4/2008 |
| GB | 2349607 | A | 11/2000 |
| JP | 62280801 | A | 12/1987 |
| JP | 62280804 | A | 12/1987 |
| JP | 01-265204 | | 10/1989 |
| JP | 01-270002 | | 10/1989 |
| JP | 01-270003 | | 10/1989 |
| JP | 01-279205 | | 11/1989 |
| JP | 07-031831 | | 2/1995 |
| JP | 2000-211244 | | 8/2000 |
| JP | 2004516963 | A | 6/2004 |
| JP | 2004-306589 | | 11/2004 |
| JP | 2008183820 | A | 8/2008 |
| JP | 2009-083267 | | 4/2009 |
| JP | 2010-000742 | | 1/2010 |
| JP | 2010069682 | | 4/2010 |
| JP | 2010241119 | A | 10/2010 |
| JP | 2010269574 | | 12/2010 |
| WO | 02053383 | A2 | 7/2002 |
| WO | WO03103970 | A2 | 12/2003 |
| WO | 2008001051 | | 1/2008 |

* cited by examiner

INKJET PRINTER WITH CONTROLLED OXYGEN LEVELS

BACKGROUND OF THE INVENTION

1. Technical Field

The invention relates to the field of inkjet printing. More specifically, the invention relates to a process for controlling the composition of an atmosphere exposed to a curable ink in a radiation curing print process.

2. Description of the Related Art

Inkjet printing involves producing a digital image on a substrate by propelling droplets of liquid material (ink) onto the substrate. Inkjet printing solutions can involve using base coats, electromagnetic radiation, curing, and inerting a print region with an inerting atmosphere.

Some printing solutions involve applying a base coat to a substrate before printing a desired image. For example, in order to print color images on non-white substrates, such as colored or transparent substrates, it is typically necessary to deposit a layer of white ink to serve as a backdrop for the color inks. Also, to print a multi-colored image on a black or colored substrate, the area of the substrate on which the image is to be printed is first pre-coated with a layer of white ink, and then the image is printed on top of the white pre-coat layer. The white background layer prevents the colors in the image from being distorted by the black or colored substrate Additionally, when printing on a transparent substrate, the colored inks may be applied on the reverse side of the substrate, so that the image may be viewed through the front side of the substrate. Then, a layer of white ink is printed over the colored ink pattern in a post-coating step. The white "post coat" layer serves as a backdrop so that the colors of the image appear properly when viewed from the front side of the transparent substrate. In some cases, the transparent substrate is then laminated onto a second transparent substrate, such as a window, so that the color image is protected between the two transparent substrates.

The Applicants have developed methods and apparatus for printing a coating layer in co-pending United States Patent publication no. 20060158473, filed on Jan. 19, 2006, entitled Methods and apparatus for backlit and dual-sided imaging, which is incorporated herein in its entirety.

According to United States Patent publication no. 20060158473, an array of print heads arranged along a single print head axis is configured to print images and a coating layer on a substrate during a single printing step (i.e., without requiring separate pre-coat or post-coat processing). In particular, a print apparatus deposits a first image layer on a substrate, then deposits a coating layer over the first image layer, and then deposits a second image layer over the coating layer.

The coating layer may comprise a specialized printing fluid such as a substantially white ink. The substrate is oftentimes a substantially translucent or substantially clear material, such as glass or plastic media. Indeed, these printing techniques are useful for backlit imaging and dual-sided imaging.

Although basic base coating techniques have been previously developed, there is a need in the art for methods and systems for controlling the quality and characteristics of the base layer, wherein these characteristics affect the overlaid image. Currently, characteristics such as dot gain, interlayer adhesion and slip are controlled by using additives such as silicone based surfactants.

Additionally, an inert gas, such as nitrogen or carbon dioxide is commonly used in radiation curable processes to enhance cure speed, particularly surface cure by reducing oxygen that reduces cure speed as a result of competing triplet and radical quenching reactions.

Some printing solutions also involve light curing of inks. Known ink-curing techniques involve using a specific ink formulation and exposing it to energy from an electromagnetic radiation source. The goal in both conventional and inkjet printing is to enable cure with reduced dose and or power of actinic radiation. Curing of liquid chemical ink formulations has been an established practice for many years. In ultraviolet curing, a liquid chemical formulation comprising photoinitiators, monomers and oligomers, and possibly pigments and other additives is exposed to ultraviolet light, thereby converting the liquid chemical formulation into a solid state.

Curing ink involves directing photons, typically with wavelengths in the ultraviolet spectrum, onto an ink deposit. The photons interact with photoinitiators present within the ink, creating free radicals. The created free radicals initiate and propagate polymerization (cure) of the monomers and oligomers within the ink. This chain reaction results in the ink curing to a polymer solid. However, the presence of oxygen at the ink surface inhibits such a chain reaction from occurring within the ink. This is often referred to as oxygen inhibition.

In normal ultraviolet curing in an air environment, a high amount of ultraviolet energy and/or a high concentration of photoinitiator are needed to achieve full cure, compared to the ultraviolet power and photoinitiator concentration required in an oxygen free curing environment. Higher photoinitiator concentration may deleteriously affect the final film properties, and increase ink costs. Higher ultraviolet energy required to overcome oxygen inhibition increases power requirements and heat generated on the sample.

Common solutions for providing for less reactive curing include completely supplanting atmospheric oxygen with a less reactive gas such as nitrogen in the cure zone. For example, U.S. Pat. No. 6,126,095 to Matheson et al., entitled "Ultraviolet Curing Apparatus Using an Inert Atmosphere Chamber" teaches a curing apparatus comprising a curing chamber for accommodating a controlled atmosphere. The curing chamber includes inlets and nozzle assemblies for supplying less reactive gas into the chamber and maintaining a less reactive atmosphere therein.

The prior art involves specialized and expensive approaches to providing reduced oxygen curing conditions, but fall short of achieving feasibility for common inkjet printing systems. For example, curing chambers demand a large footprint and are typically expensive to obtain, operate, and maintain. Additionally, large curing chambers have unacceptable levels of power consumption and heat production, requiring the use of heat sinks and other cooling systems.

According to the current state of the art, while adding a surfactant to an undercoat such as a clear or white, enables sufficient spread and a smooth surface, the adhesion and print quality of the subsequent printed layer may be negatively impacted. This is particularly pertinent to inkjet printing where drops must spontaneously spread to cover the surface and there is no contact pressure to enhance spread that is found in many conventional printing processes. For ink jet printing, some of the above mentioned current practices, such as the use of particulate matting agents, are not accessible. This is because the size of the particulate, in order to be effective, exceeds the size that the print-head can accommodate.

Additionally, the majority of current ink-curing solutions utilize high pressure arc lamps for curing. However, there are several drawbacks to these techniques.

First, typical light-curing systems that use arc lamps possess a very large physical footprint. In the case of a system for base coat printing followed by a top coat, a first printer having a UV curing station sets down and cures the base coat while an additional printer is required to set down the top coat. It would be highly beneficial to reduce the physical size of printers with light-curing stations. Likewise, it would be highly beneficial to eliminate the need for two printers in a two-step printing process.

Also, known current light-curing systems that use high pressure arc lamps produce a very high level of heat. This high level of heat prevents a traditional curing lamp from being placed in-line with other printing processes. Accordingly, heat sinks are required to remove excess heat. Likewise, traditional light-curing printing techniques release ozone which must be evacuated or otherwise removed.

Therefore, there is a need in the art for a solution that provides adequate curing, without requiring a large footprint, without requiring large amounts of power, and without producing unacceptable levels of heat while at the same time maintaining acceptable levels of print quality and interlayer adhesion.

SUMMARY OF THE INVENTION

In view of the foregoing, the invention provides a small footprint, in-line printing apparatus with an inerting station that delivers an atmosphere having an optimal composition to inert a deposit of ink such that light generated by an light emitting diode (LED) adequately cures the ink. Likewise, the invention provides a process for configuring a printing environment for delivering an atmosphere having an optimal composition to inert a layer of ink such that LED radiation adequately cures the ink.

The invention also provides a printing system with a pressurized air source and nitrogen source configured for controlling the levels of oxygen and inert gas in an inerting region of a printer. Likewise, the invention provides a printing system having a compressed air source, a nitrogen generator for controlling the levels of oxygen and inert gas in an inerting region of a printer.

The invention also provides a computer-operated printing environment that allows a user to control an inerting gas purity for delivering to an inerting station that delivers an atmosphere to inert a layer of ink in an LED curing system.

The invention also provides a method of dynamically controlling surface attributes in a print job by accepting instructions from a user-controlled computer for altering said at least printing method variable, wherein the alteration of said at least one printing method variable changes at least one print attribute of said print job.

DETAILED DESCRIPTION OF THE INVENTION

Systems and methods are provided for introducing an at least partially inert gas in a curing region of a printing apparatus to support an ideal curing of the ink.

For the purposes of the invention, the term "inert" shall mean an atmosphere having a reduced level of any substance that inhibits a desired rate of curing for ink. In the presently preferred embodiments, "inert" refers to an atmosphere having a reduced level of gaseous oxygen while this was done with increased levels of nitrogen, those with ordinary skill in the art having the benefit of this disclosure will readily understand that "inert" can refer to the reduction of oxygen by means of other non-reactive gasses.

As explained above, the current state of the inkjet printing art utilizes high power lamps for curing of a base layer ink. As noted above, these systems prevent a two-step, base-coating and top-coating printing process from being performed in-line due to curing and heat concerns. In the presently preferred embodiments of the invention, light-emitting diodes (LEDs) are utilized to improve on the bulky, hot prior art systems. Additionally, LEDs increase curing uniformity and increased printer longevity. According to the invention, an improved curing process allows the design of low-profile, low-heat curing station that does not require a segmented, two-printer process.

In some embodiments of the invention an inert (reduced oxygen) atmosphere is introduced into a curing region of a printing apparatus to obtain sufficient cure when using inks that cure by means of a free radical mechanism that is initiated by actinic radiation. Surprisingly, we have found that using higher levels of purity does not yield the required surface characteristics and that controlling the level of the oxygen in the inert gas yields better results.

In the presently preferred embodiments of the invention, the level of oxygen in the inert gas is adjusted in order to control surface characteristics of the printed layers.

Also in the presently preferred embodiments, a white ultraviolet (UV) curable inkjet ink is printed on a substrate in an at least partially inerted atmosphere. In some embodiments of the invention, the white ink acts as a base layer for one or more subsequent layers of color ink.

Figure 1A:
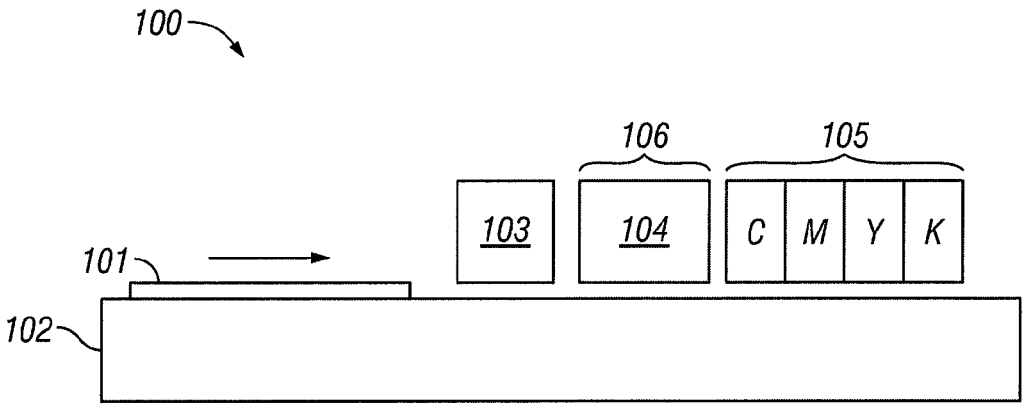
FIG. 1A illustrates an inkjet printing apparatus configured to deposit a base layer that is cured with an array of light-emitting diodes before a layer of color ink is deposited on the cured base layer according to some embodiments of the invention.

FIG. 1A illustrates an inkjet printing apparatus 100 configured to deposit a base layer that is cured with an array of light-emitting diodes (LED) before a layer of color ink is deposited on the cured base layer. The inkjet printing apparatus 100 at least comprises a platen 102, a base-layer printhead 103, a curing region 106 with a curing lamp 14 and a color printing region 105 having a plurality of printheads.

According to FIG. 1A, substrate 101 traverses the platen 102, as indicated by an arrow, and directed through a series of print applicators. The substrate 101 is first exposed to a set of base-layer printheads 103 for applying a base coat to the substrate. In the presently-preferred embodiments of the inventions, the base-layer printheads 103 are configured to stream white ink. In some embodiments of the invention, the base-layer printheads 103 are configured to apply a flood layer of white ink to substantially cover the entire face of the substrate 101. In some other embodiments of the invention, the base-layer printheads 103 are configured to spot-color particular areas of the substrate 101 which will subsequently receive a layer of color overprint (as explained below) or which will otherwise be left white. Those with ordinary skill in the art having the benefit of this disclosure will readily appreciate that any number of base-layer techniques, now known or later developed, will equally benefit from the teachings of the invention, as disclosed broadly herein.

The substrate 101 receives at least some base-layer of ink before being transported to a curing region 106 of the inkjet printing apparatus 100. The curing region 106 includes a curing lamp 104 for exposing the base-layer with electromagnetic illumination, thereby curing the deposited ink. As explained above, in the presently-preferred embodiments of the invention, the curing lamp 104 comprises light-emitting diodes (LEDs). However, it will be readily apparent to those with ordinary skill in the art having the benefit of the disclosure that other types of lighting technology are equally applicable.

In presently preferred embodiments of the invention, the curing lamp 104 is configured to emit light in the ultraviolet (UV) range. However, those with ordinary skill in the art having the benefit of this disclosure will readily appreciate that a number of other visible and invisible colors and level of brightness are equally applicable to achieve the invention, as disclosed broadly herein.

Next, the substrate 101 with a cured base-layer is transported to a color printing region 105. As shown in FIG. 1A, the printing region 105 includes printheads defining the CMYK color model. However, it will be readily apparent to those with ordinary skill in the art having the benefit of the disclosure that other color models, now known or later developed, are equally applicable to accomplish the invention, as disclosed broadly herein.

Figure 1B:
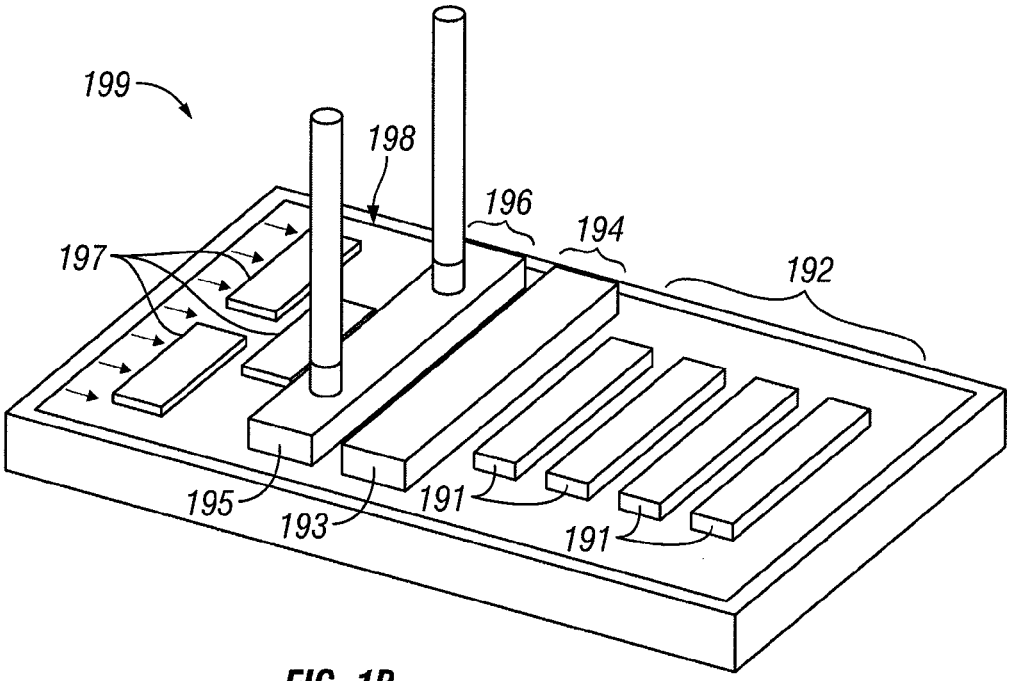
FIG. 1B illustrates an inkjet printing apparatus 199 with a set of base-layer printheads, an inerting region, a curing lamp, and a color printing region according to some embodiments of the invention.

In the presently preferred embodiments of the invention, the white UV curable inkjet base-layer ink is printed on a substrate and cured using LED lights under a controlled level of an inert gas, such as nitrogen. FIG. 1B illustrates a view of printing region of an inkjet printing apparatus 199 configured to deposit a base layer on a substrate under a controlled level of nitrogen that is cured with an array of light-emitting diodes (LED) before a layer of color ink is deposited on the cured base layer.

FIG. 1B illustrates an inkjet printing apparatus 199 with a platen 198 for supporting a substrate (not shown) in the direction of the arrows. A set of base-layer printheads 197 are configured to apply a base-layer of ink as the substrate is transported underneath. The substrate having a base-layer printed thereon is then transported through an inerting region 196 comprising an inert gas applicator 195. The substrate then travels to a curing region 194 with a curing lamp 193 and a color printing region 192 having a plurality of printheads 191.

Although FIG. 1B describes a system for supplying a cure region with an inerting gas in a fixed print head printer having a platen for supporting a moving substrate, it will be readily apparent to those with ordinary skill in the art having the benefit of this disclosure that the inerting gas can be used in any curing region for any printer type, now known or later developed.

Figure 2:
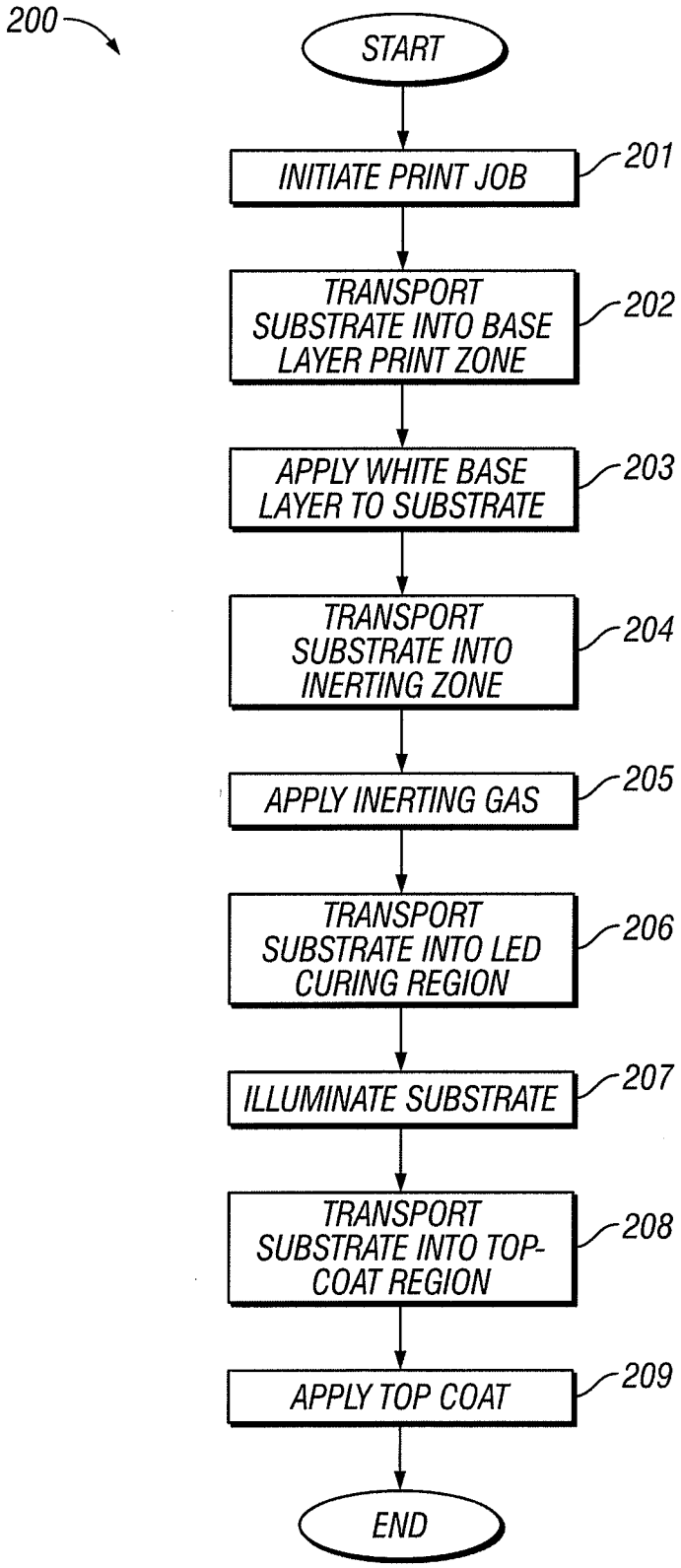
FIG. 2 illustrates a printing process of light-curing ink in an inerting region according to some embodiments of the invention.

FIG. 2 illustrates a printing process 200 of light-curing ink in an inerting region according to some embodiments of the invention. The process 200 begins by initiating a print job 201 that involves transporting a substrate through a series of in-line printing regions or zones. First, the substrate is transported to a base-layer print zone 202 where a base-layer is applied to the substrate 203. The base-layer is preferably white.

Next, the substrate, with a base-layer applied, is transported to an inerting zone 204 of the printing apparatus where the substrate is exposed to an inerting gas 205. The substrate is then transported to a curing region 206 and illuminated 207, thereby curing the base-layer. Finally, the substrate having a cured base-layer is transported into a top-coat region 208 and a top-coat layer is applied thereon 209.

Using the system and process as generally described in FIG. 1B and FIG. 2, the surface quality of the printed image and the interlayer adhesion of subsequent color layers varies with the particular mixture of environmental atmosphere, i.e. air, and an inerting gas. Surface quality refers to the finish of the image, i.e. smoothness. Interlayer adhesion refers to the relative ease or difficulty to remove the colored layer of ink from the white layer by scratching or by cross hatch and tape test. Using the observation that the print attributes vary with varying mixtures of atmosphere composition, the inventors conducted experiments to examine how varying levels of nitrogen and oxygen present in an inerting region of a printing process affects the quality of the printed image.

The inventors found that a high level of nitrogen purity gives a smooth white surface on which the subsequent layer of colored inks, when printed on that surface, spreads and gives a high quality image. On that surface, while the print quality is good, we found that the interlayer adhesion between the colored inks and the white layer is poor. On the other hand, curing the white layer without the use of an inert gas results in good interlayer adhesion. Good interlayer adhesion generally describes a printed substrate in which it is difficult to remove the colored layer of ink from the white layer by scratching it or by cross hatch and tape test. In these cases, while interlayer adhesion was sufficient, spread of the second layer of colored inks on the insufficiently cured white layer was poor, yielding a flawed image with observable lines between individual jets.

Therefore, it is desirable to have control over the amount of nitrogen and oxygen in a curing process in order to control the print quality. Indeed, the presently preferred embodiments of the invention involve a process whereby the inert gas which envelops the area where UV light is impinging on freshly printed ink has a controlled level of oxygen in order to obtain surface characteristics. In a particular embodiment, a white inkjet ink is printed on a substrate and an LED lamp is used to cure the ink under a controlled concentration of oxygen in order to obtain required characteristics, i.e. both sufficient spread of the subsequently printed inks and good interlayer adhesion.

In some embodiments of the invention, a static composition of inerting gas is established based on the resultant printing characteristics and that composition is used exclusively. In some other embodiments of the invention, a controller configured to adjust the composition of the inerting gas is dynamically configurable such that the resultant printing characteristics are adjustable.

In the presently preferred embodiments of the invention, a printing system includes an inerting gas controller for controlling the levels of oxygen and inert gas in an inerting region of a printer.

Figure 3A:
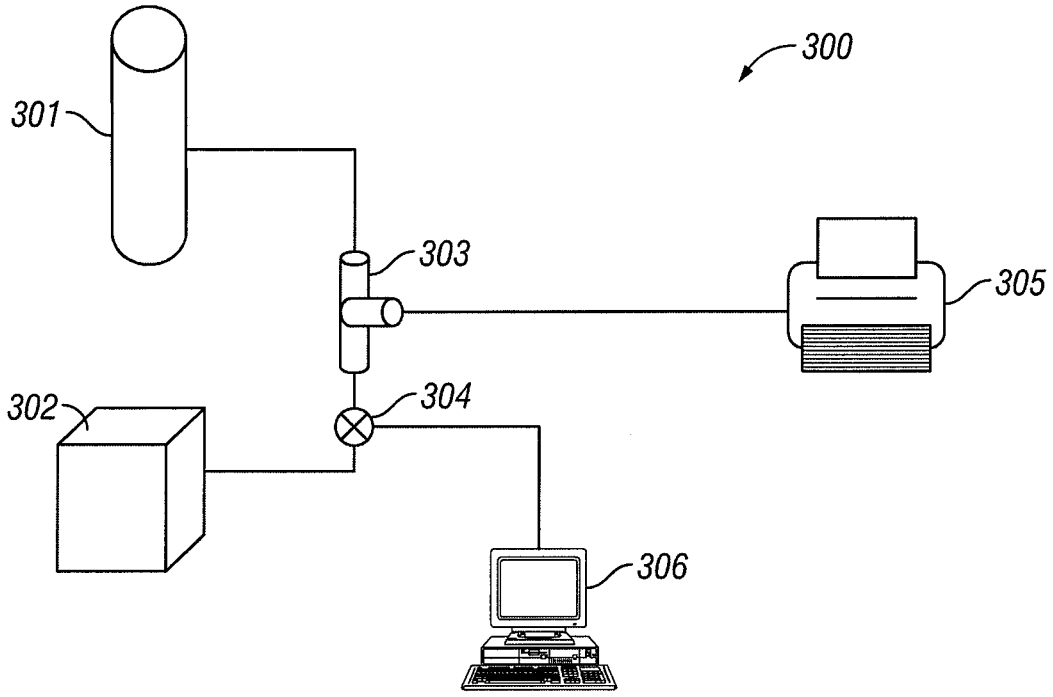
FIG. 3A illustrates an example of a printing system with a pressurized air source and nitrogen source configured for controlling the levels of oxygen and inert gas in an inerting region of a printer.

FIG. 3A illustrates an example of a printing system 300 having a printer 305, nitrogen source 301, an air source 302, a three-way connector 303, and an air flow valve 304 for controlling the levels of oxygen and inert gas in an inerting region of a printer 305. The printer 305 receives print jobs from one or more computers 306.

According to FIG. 3A, a high-purity nitrogen gas composition from the nitrogen source 301 is intentionally contaminated with oxygen from the air source 302. The flow rate of the air from the air source 302 is metered using an air flow valve 304 to control the amount of intentional air contamination. In some embodiments of the invention, the air source 302 is an air pump. In some other embodiments the air source 302 is a pressurized oxygen container.

In some embodiments, a three-way connector 303 couples the nitrogen source 301, the air source 302, and a nitrogen applicator (not shown) in the printer 305. The purity of the nitrogen source is fixed; therefore, as the air flow valve is opened, the purity of the nitrogen stream is lowered. In the presently preferred embodiments of the invention, the nitrogen applicator is placed before an LED lamp (not shown) as explained above.

In some embodiments of the invention, the air flow valve 304 is coupled with a user computer 306. The user computer 306 at least comprises a processor, a memory, a display, a user input device, and a graphical user interface. According to these embodiments, a user may adjust the levels for the composition of gas delivered to the printer 305. Accordingly, the user can adjust the resultant print quality. In some embodiments, the printer 305 receives a print job from a first computer and the inerting gas purity is controlled in by an additional computer. In some other embodiments, the same computer initiates the print jobs and controls the purity level of the inert gas.

In some other embodiments of the invention, a membrane-based nitrogen generator is used to supply inerting gas, wherein incoming air pressure and flow are used to control the oxygen level of the inerting gas. These embodiments replace those embodiments using a nitrogen source, an air source, and a mixer. Indeed, eliminating nitrogen or oxygen tanks obviates the need for consumable nitrogen or oxygen tanks that constantly require replacement and that can be expensive. Furthermore, the elimination of tanks further reduces the footprint of the system.

In some embodiments of the invention, an adsorption gas separation process is used to generate nitrogen. In some other embodiments, a gas separation membrane is used to generate nitrogen. According to the embodiments in which a membrane is used, a compressed air source delivers air that is first cleaned to remove oil vapor or water vapor. The clean, compressed air is then driven through a series of membranes to separate oxygen out of the air, resulting in a gas having higher levels of nitrogen. The resultant amount of nitrogen in the resultant gas can be controlled by changing the system pressure and the flow rate of air through the system. Accordingly, the resultant inerting gas is controllable.

Figure 3B:
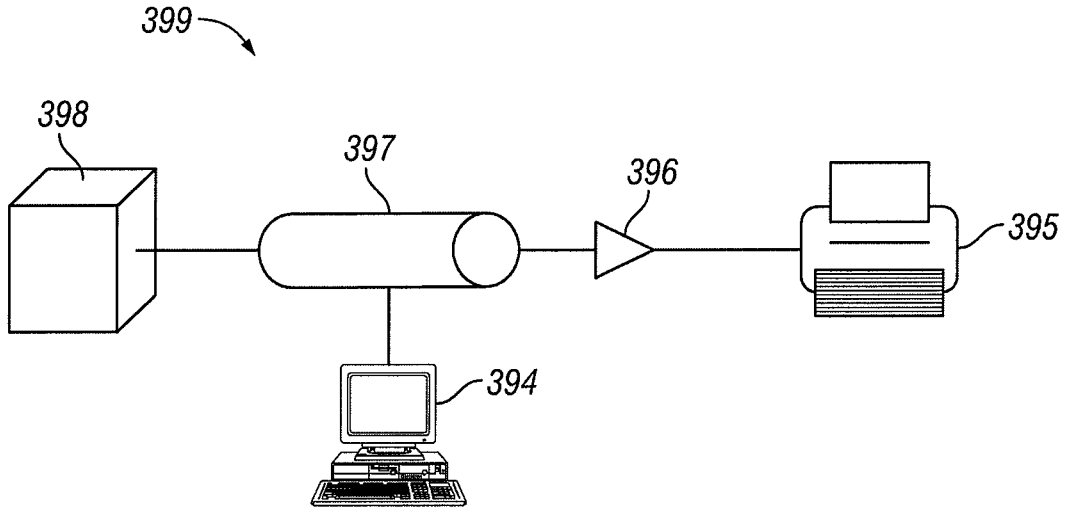
FIG. 3B illustrates an example of a printing system having a compressed air source, a nitrogen generator for controlling the levels of oxygen and inert gas in an inerting region of a printer.

FIG. 3B illustrates an example of a printing system 399 having a compressed air source 398, a nitrogen generator 397, a flow-meter 396, and a printer 395.

The compressed air source 398 is attached to the inlet of the nitrogen generator 397. The purity of the separated nitrogen exiting the generator is controlled by the pressure and flow rate of gas traveling through the membrane(s) of the nitrogen generator 397. As pressure is increased, the output nitrogen purity increases. As gas flow rate through the membrane is increased, the output purity decreases. The outlet of the nitrogen generator 397 is attached to the inlet of a flow-meter 396 to control the amount of nitrogen applied to the printer 395. The outlet of the flow-meter is attached to the nitrogen applicator (not shown). The nitrogen applicator is placed in the printer 395, before the curing lamp, so that curing takes place under a controlled atmosphere.

In any of the embodiments, the connection to the nitrogen applicator can be broken and an $O_2$ sensor can be placed in line to determine its concentration of $N_2$.

In some embodiments of the invention, nitrogen generator 397 is coupled with a user computer 394. The user computer 394 at least comprises a processor, a memory, a display, a user input device, and a graphical user interface. According to these embodiments, a user may adjust the levels for the composition of gas delivered to the printer 395. Accordingly, the user can adjust the resultant print quality.

As will be understood by those familiar with the art, the invention may be embodied in other specific forms without departing from the spirit or essential characteristics thereof. Likewise, the particular naming and division of the members, features, attributes, and other aspects are not mandatory or significant, and the mechanisms that implement the invention or its features may have different names, divisions and/or formats. Accordingly, the disclosure of the invention is intended to be illustrative, but not limiting, of the scope of the invention, which is set forth in the following Claims.

EXAMPLE

Examples of the printing process are described below. Representative examples of samples printed under various levels of oxygen are discussed herein with reference to FIGS. 4A, 4B, and 4C.

In prior art focus is on decreasing energy required for cure by decreasing oxygen to as low a level as possible in the curing environment. The example herein shows that extremely low oxygen levels do not give ideal print characteristics. Instead, there is an ideal range of oxygen concentration that will yield optimal print characteristics, including, but not limited to mar resistance, dot gain, and adhesion.

In this example, a printer is described that deposits a white ink formulated to cure under an LED light source. This white ink is comprised of acrylate monomers and oligomers, photoinitiator, dispersed pigment, and additives. Mixtures of acrylate monomers and oligomers are found in concentrations of 30 to 70% by weight, more ideally from 40-60% by weight. Mixtures of photoinitiators chosen to react under an LED light source are found in concentrations of 3-15% by weight, more ideally from 5-10% by weight. The dispersed pigment is comprised of monomers, oligomers, dispersants, and titanium dioxide pigment. The titanium dioxide pigment is found in concentrations of 10-40% by weight, more ideally 15-30% by weight.

In this example, the printer utilizes print heads to deposit the LED curable white ink to a transparent or colored substrate. Upon deposit, the printer's web drive moves the substrate with deposited ink into a nitrogen application region. The nitrogen application displaces the ambient atmosphere composition, replacing the space above the deposited white ink with a controlled oxygen atmosphere. The substrate and altered atmosphere continues to move into the LED curing region, where the LED lamp cures the white deposit. The web continues to the overprint color region, where print heads deposit additional colors to the cured white ink. The web continues to travel to a mercury vapor lamp in order to cure the additional colors.

Figure 4A:
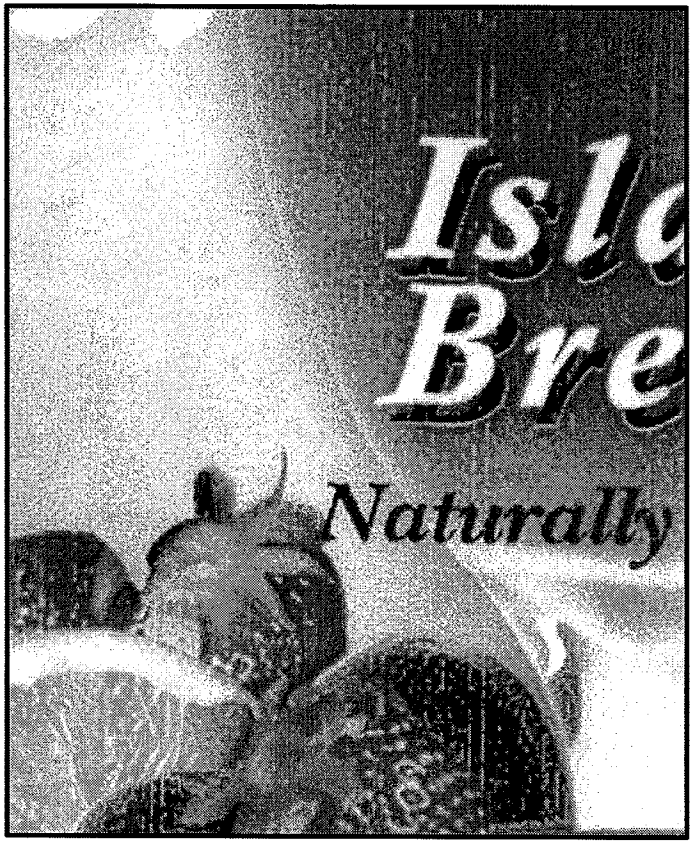
FIG. 4A is a page printed using a single pass UV curable white inkjet ink which has been formulated to cure under an LED light source.
Figure 4B:
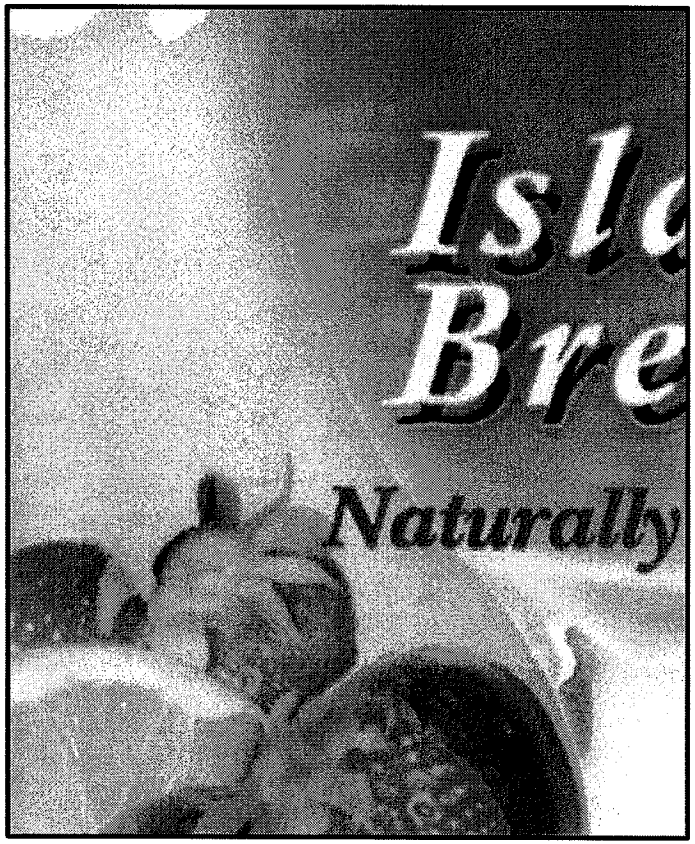
FIG. 4B is a page printed by applying high purity nitrogen source over the printed white ink as it passes under the curing unit alters the surface cure and produces a glossy cured hard surface.
Figure 4C:
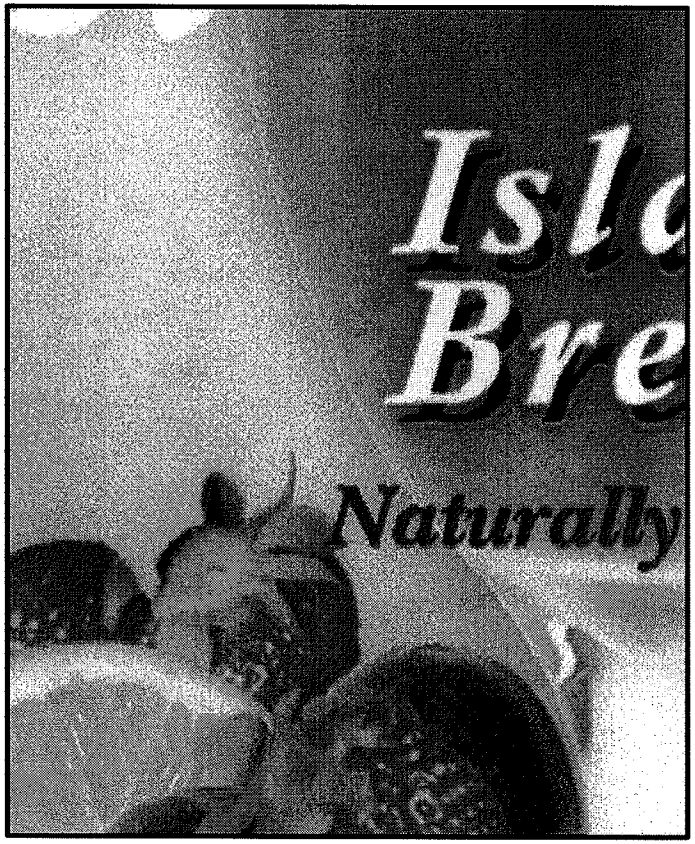
FIG. 4C is a page printed by applying a lower purity nitrogen source to the top of a printed ink as it passes under the curing unit alters the surface cure and allows for a glossy cured surface.

FIGS. 4A, 4B, and 4C are examples of prints generated with the white ink cured in atmospheres with various oxygen concentrations.

FIG. 4A is a page printed using a single pass UV curable white inkjet ink which has been formulated to cure under an LED light source. Without using an inert atmosphere when inks are cured, the surface of the cured ink will have a matte finish. In addition to being matte, the surface of the cured ink is softer and can mar when scratched. Poor surface cure does not provide an adequate surface to overprint on, as overprinted ink dot sizes are not sufficient to achieve solid color fill and images appear distorted as shown in FIG. 4A. Typical oxygen concentration of a standard atmosphere is around 21%.

FIG. 4B is a page printed by applying high purity nitrogen source over the printed white ink. Oxygen concentration in this example range from 3-0%, and more ideally from 1%-0% The atmosphere as the ink deposit passes under the curing unit alters the surface cure and produces a glossy, hard cured surface. White inks cured in this manner have good scratch resistance and do not mar easily. Inks deposited on this white layer show sufficient dot gain and good quality but do not exhibit good interlayer adhesion between the under-layer (in this case white) and overprinted top layer of colored ink. The higher quality of the colored ink printed on a white cured under high purity nitrogen can be seen below.

FIG. 4C is a page printed by applying a median level of oxygen over the printed white ink. Oxygen concentration in this example range from 10-3%, and more ideally from 3-4%. The atmosphere as the ink deposit passes under the curing alters the surface cure and allows for a glossy cured surface. White inks cured in this manner have good scratch resistance and do not mar easily. Unlike the white layer cured under the lowest level of oxygen the samples also exhibit good interlayer adhesion between the cured under layer (white) and cured overprinted layer (color ink). The higher quality of the colored ink printed on a white cured under high purity nitrogen can is exhibited in the same manner as the high purity nitrogen print example 4B.

The invention claimed is:

1. A printing apparatus comprising:

a gas source operable to provide oxygen and to provide a non-reactive gas for an inerting gas;

a controller operable to control a level of said oxygen and a level of said non-reactive gas to vary a composition of said inerting gas from said gas source; and a printer comprising:

a sequential in-line printing assembly comprising:

a base coat print head;

an inerting gas applicator;

a curing region configured to provide illumination; and a top coat print head; and a transport system for transporting a substrate through said sequential in-line printing assembly such that said substrate is sequentially treated with a base coat ink, an inerting gas atmosphere, curing illumination from said curing region, and a top coat ink, wherein said gas source is coupled in fluid communication with said inerting gas applicator, wherein said inerting gas is delivered to said sequential in-line printing assembly via said inerting gas applicator; and wherein said controller is configured to vary said level of said oxygen and said level of said non-reactive gas in said composition of said inerting gas, to controllably deliver said oxygen through said inerting gas applicator in a range that simultaneously provides in a given print job both sufficient spread of said top coat ink, and interlayer adhesion between said base coat ink and said top coat ink.

2. The printing apparatus of claim 1, wherein said non-reactive gas comprises nitrogen, and wherein said gas source comprises:

a pressurized nitrogen gas source for providing said nitrogen;

a pressurized air source for providing air including said oxygen;

a three-way connector comprising:

a first inlet coupled in fluid communication to said pressurized nitrogen gas source;

a second inlet coupled in fluid communication to said pressurized air source, and an outlet coupled in fluid communication to said inerting gas applicator; and an air flow valve coupled between said pressurized air source and said three-way connector, wherein said air flow valve is operable to control flow of said air to said three-way connector, thereby controlling said level of said oxygen and said level of nitrogen output from said outlet.

3. The printing apparatus of claim 2, further comprising:

a computer coupled with said air flow valve, said computer comprising:

a processor;

a memory;

a user input; and a user interface;

wherein said computer is configured for accepting instructions from a user via said user interface and controlling the flow of said air to said three-way connector.

4. The printing apparatus of claim 1, wherein said non-reactive gas comprises nitrogen, and wherein said gas source comprises:

a pressurized air source for supplying air having a chemical composition, wherein said chemical composition includes said nitrogen and said oxygen;

a nitrogen generator having an air inlet coupled in fluid communication to said pressurized air source and an outlet in fluid communication to said inerting gas applicator, wherein said nitrogen generator is configured to increase said level of said nitrogen in said chemical composition to form said inerting gas; and an air flow valve coupled between said pressurized air source and said inerting gas applicator, wherein said air flow valve controls said flow of said inerting gas to said inerting gas applicator.

5. The printing apparatus of claim 1, wherein said base coat print head comprises a white print head.

6. The printing apparatus of claim 1, wherein said top coat print head comprises a plurality of print heads, wherein at least one of said plurality of print heads is configured to dispense a clear undercoat.

7. The printing apparatus of claim 6, wherein said top coat print head comprises a plurality of print heads, wherein at least one of said plurality of print heads is configured to dispense a color from a standardized inkset.

8. The printing apparatus of claim 1, wherein said curing region comprises a plurality of light-emitting diodes (LEDs).

9. The printing apparatus of claim 1, wherein said varied level of said oxygen is further configured to alter dot gain of said top coat ink.

10. The printing apparatus of claim 1, wherein said varied level of said oxygen is further configured to alter mar resistance of any of said base coat ink and said top coat ink.

11. A method comprising:

arranging a printing environment by configuring a controller for controlling a level of oxygen and a level of a non-reactive gas to vary a composition of an inerting gas emitted by an inerting gas source;

configuring a base layer application region;

configuring an inerting region;

configuring a curing region;

configuring a top coat region; and configuring a transport for transporting a substrate sequentially through said base layer application region, said inerting region, said curing region, and said top coat region;

initiating a print job for applying and curing a base layer of ink and applying a top coat layer of ink to said substrate;

applying, in said base layer application region, said base layer of ink to said substrate, thereby forming a base-applied substrate;

exposing, in said inerting region, said base-applied substrate to an atmosphere at least partially composed of said inerting gas emitted by said inerting gas source that, when present in said curing region, facilitates a curing process, thereby forming a cure-ready substrate;

illuminating, in said curing region, said cure-ready substrate to electromagnetic radiation, thereby forming a base-cured substrate;

applying, in said top coat region, a top coat of ink to said based-cured substrate; and controlling with said controller said level of said oxygen and said level of said non-reactive gas to vary said composition of said emitted inerting gas in said atmosphere to controllably deliver said oxygen in a range that simultaneously provides in said print job both sufficient spread of said top coat of ink, and interlayer adhesion between said base layer of ink and said top coat of ink.

12. The method of claim 11, wherein said non-reactive gas comprises nitrogen, and wherein said method further comprises:

configuring a pressurized nitrogen gas source for providing said nitrogen;

configuring a pressurized air source for providing air including said oxygen;

configuring a three-way connector comprising:

configuring a first inlet coupled in fluid communication to said pressurized nitrogen gas source;

configuring a second inlet coupled in fluid communication to said pressurized air source, and configuring an outlet coupled in fluid communication to said inerting gas applicator; and configuring an air flow valve coupled between said pressurized air source and said three-way connector, wherein said air flow valve controls the flow of said air to said three-way connector, thereby controlling said level of said oxygen and said level of said nitrogen output from said outlet.

13. The method of claim 12, further comprising:

configuring a computer coupled with said air flow valve, said computer comprising:

a processor;

a memory; and a user interface, wherein said computer is configured for accepting instructions from a user via said user interface and controlling the flow of said air to said three-way connector.

14. The method of claim 11, wherein said non-reactive gas comprises nitrogen, and wherein said method further comprises:

configuring a pressurized air source for supplying air having a chemical composition, wherein said chemical composition includes said nitrogen and said oxygen;

configuring a nitrogen generator having an air inlet coupled in fluid communication to said pressurized air source and an outlet in fluid communication to said inerting gas applicator, wherein said nitrogen generator is configured to increase a level of said nitrogen in the chemical composition; and configuring an air flow valve coupled between said pressurized air source and said inerting gas applicator, wherein said air flow valve controls the flow of said chemical composition to said inerting gas applicator.

15. The method of claim 11, wherein said applying said base layer of ink to said substrate comprises applying white ink to said substrate.

16. The method of claim 11, wherein said applying said top coat of ink comprises applying color ink using a CMYK color model.

17. The method of claim 11, wherein said illuminating, in said curing region, said cure-ready substrate to electromagnetic radiation comprises LED illumination.

18. The method of claim 11, wherein said varying of said composition of said inerting gas alters the dot gain of said base layer.

19. The method of claim 11, wherein said varying of said composition of said inerting gas alters the mar resistance of any of said base layer of ink and said top coat of ink.

20. A non-transitory computer readable medium containing executable instructions that, when executed by a computer, performs said method of claim 11.

21. A method of dynamically controlling surface attributes in a print job, the method comprising:

configuring a user-controlled computer having an interface for altering a printing method variable;

operatively coupling said user-controlled computer with an inerting gas source for delivering an inert gas mixture, said user-controlled computer configured for controlling a level of oxygen and a level of a non-reactive gas to vary a composition of said inert gas mixture;

configuring a printer including a base layer application region, an inerting region, a curing region, a top coat region, and a transport for transporting a substrate sequentially through said base layer application region, said inerting region, said curing region, and said top coat region;

operatively coupling said user-controlled computer with said printer;

accepting instruction, by said user-controlled computer, for altering said printing method variable;

initiating a print job for applying and curing a base layer of ink to said substrate, and applying a top coat layer of ink to at least a portion of said base layer of ink;

applying, in said base layer application region, said base layer of ink to said substrate, thereby forming a base-applied substrate;

exposing, in said inerting region, said base-applied substrate to an atmosphere at least partially composed of said inert gas mixture that, when present in said curing region, facilitates a curing process, thereby forming a cure-ready substrate, wherein said atmosphere is delivered from said inerting gas source;

illuminating, in said curing region, said cure-ready substrate to electromagnetic radiation, thereby forming a base-cured substrate;

applying, in said top coat region, a top coat of ink to said based-cured substrate, wherein said controlling said level of said oxygen and said level of said non-reactive gas varies said composition of said inert gas mixture in said atmosphere to controllably deliver said oxygen in a range that simultaneously provides in said print job both sufficient spread of said top coat of ink, and interlayer adhesion between said base layer of ink and said top coat of ink; and printing said print job on said substrate.

22. A method comprising:

configuring a printer including an inerting gas source to provide oxygen and to provide nitrogen for an inerting gas, wherein the inerting gas source includes a pressurized air source for supplying air having a chemical composition, wherein said chemical composition includes said nitrogen and said oxygen, a nitrogen generator having an air inlet coupled in fluid communication with said pressurized air source and an outlet in fluid communication with an inerting gas applicator, wherein said nitrogen generator is configured to increase a level of nitrogen in the chemical composition to form said inerting gas, and an air flow valve coupled between said pressurized air source and said inerting gas applicator, wherein said air flow valve controls the flow of said inerting gas to said inerting gas applicator, a base layer application region, an inerting gas application region, a LED-curing region, a CMYK top coat region, and a transport for transporting a substrate sequentially through said base layer application region, said inerting gas application region, said LED-curing region, and said CMYK top coat region;

initiating a print job for applying and curing a white base layer of ink to said substrate and applying a CMYK top coat layer of ink to at least a portion of said applied and cured white base layer of ink;

applying, in said base layer application region, said white base layer of ink to said substrate, thereby forming a white base-applied substrate;

delivering said inerting gas to said inerting gas application region;

exposing, in said inerting region, said white base-applied substrate to an atmosphere including said delivered inerting gas, thereby forming a cure-ready substrate, wherein said atmosphere is delivered from said inerting gas source;

illuminating, in said LED-curing region, said cure-ready substrate to ultraviolet radiation, thereby forming a base-cured substrate; and applying, in said CMYK top coat region, a top coat of color ink to said based-cured substrate using a CMYK color model, wherein a relative amount of said oxygen in said delivered inerting gas is controllably delivered in a range that simultaneously provides in said print job both sufficient spread of said top coat of ink, and interlayer adhesion between said white base layer of ink and said top coat of ink.

23. The method of claim 22, wherein the non-reactive gas comprises nitrogen.

24. The method of claim 22, wherein said range of said delivered oxygen is additionally configured to provide any of a desired mar resistance or a desired dot gain of said top coat of color ink.

25. The printing apparatus of claim 1, wherein the non-reactive gas comprises nitrogen.

26. The printing apparatus of claim 1, wherein said range of said delivered oxygen is additionally configured to provide any of a desired mar resistance or a desired dot gain for said top coat ink.

27. The method of claim 11, wherein the non-reactive gas comprises nitrogen.

28. The method of claim 11, wherein said range of said delivered oxygen is additionally configured to provide any of a desired mar resistance or a desired dot gain for said top coat of ink.

29. The method of claim 21, wherein the non-reactive gas comprises nitrogen.

30. The method of claim 21, wherein said range of said delivered oxygen is additionally configured to provide any of a desired mar resistance or a desired dot gain for said top coat of ink.

* * * * *